United States Patent [19]

Stafford

[11] 4,178,838

[45] Dec. 18, 1979

[54] OIL PORTING SYSTEM FOR DUAL CYLINDER VIBRATOR

[75] Inventor: Jay H. Stafford, Ponca City, Okla.

[73] Assignee: Conoco, Inc., Ponca City, Okla.

[21] Appl. No.: 848,226

[22] Filed: Nov. 3, 1977

[51] Int. Cl.[2] ..... F01B 15/02; F15B 11/16

[52] U.S. Cl. ..... 92/117 A; 92/166; 91/39; 91/216 B; 91/533; 181/119

[58] Field of Search ..... 91/411 R, 411 B, 216 B, 91/39, 533; 92/166, 117 R, 117 A; 181/119

[56] References Cited

U.S. PATENT DOCUMENTS

| | | | |
|---|---|---|---|
| 1,843,082 | 1/1932 | Ferris et al. | 91/216 B |
| 3,745,885 | 7/1973 | Fair et al. | 91/216 B |

FOREIGN PATENT DOCUMENTS

| | | | |
|---|---|---|---|
| 2438557 | 3/1975 | Fed. Rep. of Germany | 91/411 B |
| 990671 | 6/1951 | France | 91/411 B |
| 193040 | of 1967 | U.S.S.R. | 91/411 B |

*Primary Examiner*—Paul E. Maslousky
*Attorney, Agent, or Firm*—William J. Miller

[57] ABSTRACT

A system for porting of hydraulic fluid in a hydraulically driven seismic energy vibrator of the reciprocating mass type. A mass is reciprocated relative to an earth contacting frame which includes at least two hydraulic piston rods coacting with internal cylinders within the mass. The piston rods, of the type having double rod ends, each include a single axial bore therethrough in communication with respective opposite sides of the piston ring assemblies, and cross porting is effected between opposite ends of the mass cylinders.

7 Claims, 4 Drawing Figures

OIL PORTING SYSTEM FOR DUAL CYLINDER VIBRATOR

BACKGROUND OF THE INVENTION

1. Field of the Invention

The invention relates generally to seismic energy vibrators and, more particularly, but not by way of limitation, it relates to an improved porting system for use in particular forms of vibration apparatus.

2. Description of the Prior Art

Prior vibrators that employ either single or dual pistons utilize two passages for oil to either side of the pistons. Illustrative of the prior art are U.S. Pat. Nos. 3,073,659; 3,159,233; and 3,745,885. The earlier teachings relating to reciprocating reaction mass seismic vibrators utilizing hydraulic drive have adhered to the relatively conventional methods of porting wherein the complete flow circuit is formed within the piston rod, whether it be a single or double rod end type of rod.

SUMMARY OF THE INVENTION

The present invention contemplates an improved form of seismic energy vibrator utilizing at least two double rod end piston rods for reciprocation of the reaction mass. In a more limited aspect, the invention consists of a frame assembly supporting the semismic vibrator in energy coupling contact with the earth or other receptor, and with the frame assembly being rigidly coupled to at least two double rod end piston rods which reciprocate within internally formed cylinders of a reaction mass of selected size and weight. Hydraulic fluid porting of the vibrator is carried out by means of axial flow bores through one rod end of each of the piston rods, and each is in communication with opposite side internal volumes of the cylinders so that additional porting between cylinders completes the hydraulic flow circuit.

Therefore, it is an object of the present invention to provide a seismic vibrator of the type utilized in complex frequency generation that is easier of assembly.

It is also an object of the present invention to provide a seismic vibrator that provides a stronger supporting structure for the reciprocating reaction mass.

It is still another object of the present invention to provide a method of porting in seismic vibrators of the type employing a reaction mass wherein only a single hydraulic flow passage is required for each piston rod thereby to increase structural rigidity and to enhance assembly procedures.

Finally, it is an object of this invention to provide a seismic vibrator of the reaction mass type wherein hydraulic flow porting of the piston and mass structure is simplified with attendant decrease in cost of construction and an increase in structural strength and reliability.

Other objects and advantages of the invention would be evident from the following detailed description when read in conjunction with the accompanying drawing which illustrates the invention.

DETAILED DESCRIPTION OF THE INVENTION

Figure 1:
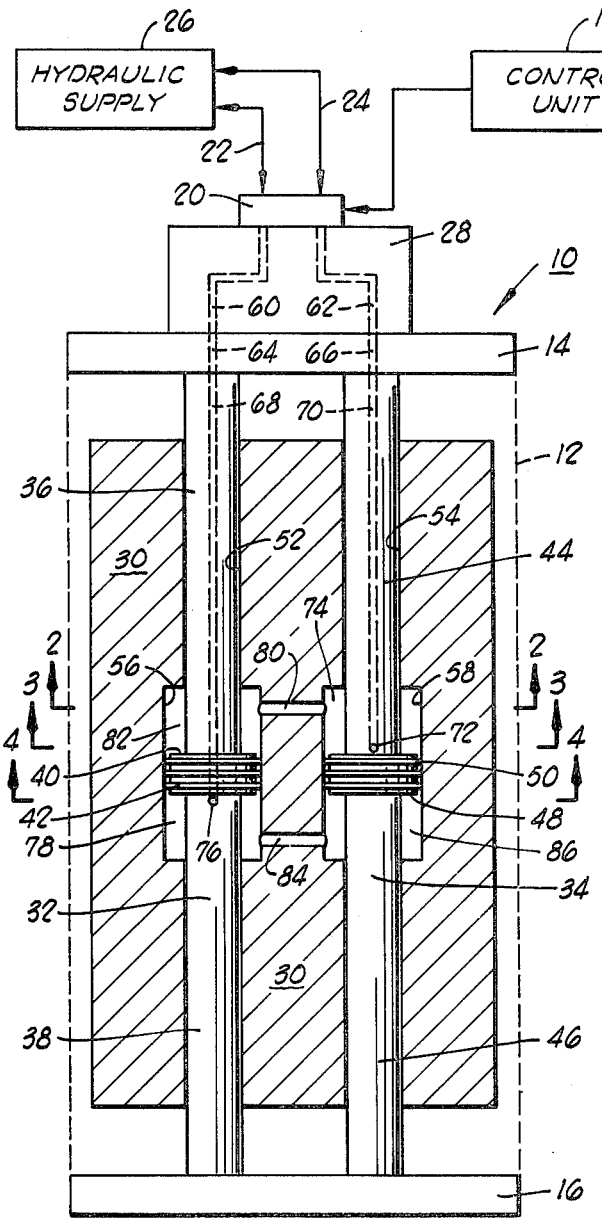
FIG. 1 is a schematic drawing in elevation of a seismic vibrator constructed in accordance with the present invention.

With reference to FIG. 1, a seismic vibrator 10 includes a support frame 12 (shown generally in dash-line) that includes frame end plates 14 and 16. The general construction of such seismic vibrators is well-known in the art such that end plate 16 would be suitably adapted by means of rigidly connected base plate or other coupling member for placement in energy coupling relationship to the earth's surface. Also, it should be well understood that a semismic vibrator such as that shown in FIG. 1 may be placed in horizontal disposition and earth coupling relationship to act as a shear wave vibrator. In this case, a suitable coupling base plate as rigidly secured to end plates 14 and 16 would be placed in earth coupling disposition.

Vibration is effected through a known form of control unit 18 controlling a servo valve 20 to apply hydraulic fluid pressure by means of lines 22 and 24 from a suitable hydraulic supply 26. Thus, the constant pressure hydraulic supply 26 applies alternating pressure via lines 22 and 24 as controlled by the servo valve 20 through a manifold 28 as secured to end plate 14. Such alternating hydraulic fluid pressure then serves to reciprocate a reaction mass 30 relative to double rod pistons 32 and 34 and end plates 14 and 16.

The double rod piston 32 includes oppositely disposed cylindrical rod ends 36 and 38 with a piston 40 having rings 42 disposed centrally therealong. In like manner, piston 34 is formed with oppositely disposed rod ends 44 and 46 with the centrally formed piston 48 carrying a plurality of piston rings 50. The number of piston rings 42 and 50 that are employed, as well as any inter ring sealing structure, will vary in accordance with design exigencies as such structure is the particular subject matter of the prior U.S. Pat. No. 3,073,659 as issued on Jan. 15, 1963 in the name of Brown. In like manner, the packing and sealing structure employed for seating and sealing of rod ends 36, 38, 44 and 46 is well-known in the art and particularly referenced in the afore-mentioned U.S. Pat. No. 3,159,233.

The reaction mass 30 is formed to have two axially parallel equi-spaced bores 52 and 54 for slidably receiving the piston rods 32 and 34. The packing and insert devices utilized around the sliding rod end surfaces of piston rods 32 and 34 are of conventional type, for example as disclosed in the afore-mentioned U.S. Pat. No. 3,159,233. The internal portions of bores 52 and 54 are each then further formed with central counterbores 56 and 58 of equal cylindrical size and similar disposition within the body of reaction mass 30 thereby to form the respective cylinders that receive pistons 40 and 48. The cylindrical bores 56 and 58 are of a diametric size consonant with sealed reciprocation of respective groups of piston rings 42 and 50.

Figure 2:
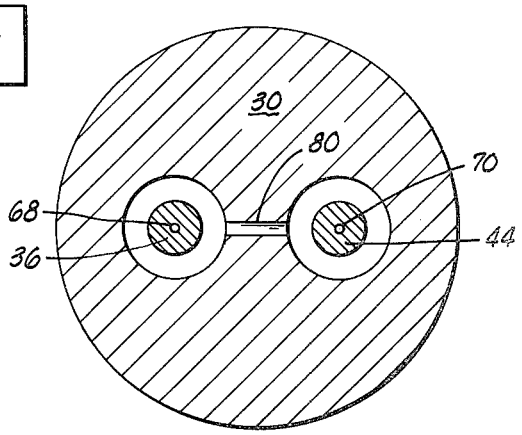
FIG. 2 is a section taken along lines 2—2 of FIG. 1.
Figure 3:
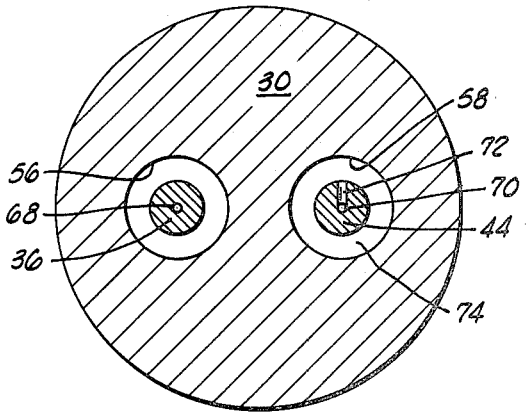
FIG. 3 is a section taken along lines 3—3 of FIG. 1.
Figure 4:
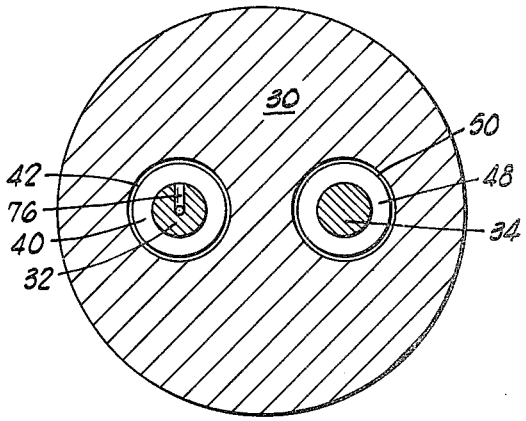
FIG. 4 is a section taken along lines 4—4 of FIG. 1.

The oil porting system is defined with further reference to FIGS. 2, 3 and 4. Thus, reciprocal application of oil pressure is applied from servo valve 20 through manifold passages 60 and 62 as secured in alignment with end frame passages 64 and 66 for communication with rod end bores or ports 68 and 70. The rod end ports 68 and 70 are preferably formed along the cylindrical axis of the rod ends and extend approximately halfway therealong for communication with the interior of the cylinder bores 56 and 58, as will be further described. The rod end port 70 extends along rod end 44 to a position just short of the piston 48 whereupon it communicates by means of a radial port 72 (See FIG. 3) with cylinder volume 74 of cylinder 58. The similar rod end port 68 of piston rod 32 extends to a position more than halfway or beyond the piston 40 for communication by means of a radial port 76 with a cylinder volume 78 of cylinder bore 56 (See FIG. 4).

A first cross port 80 (FIGS. 1 and 2) is bored between cylinder bores 56 and 58 to provide internal communication between cylinder volume 74 and its counterpart cylinder volume 82. Similarly, and in the lower part of the cylinder combination, a cross bore 84 is formed parallel to cross bore 80 and of the same size to enable communication of the lower internal cylinder volume 78 with its opposite counterpart volume 86. The size, i.e., the diameter, of cross ports 80 and 84, should in normal applications be equal and of sufficient size to avoid time delay between the paired piston movements that may arise due to compressibility of hydraulic fluid. Such size determination is a design consideration readily arrived at in consonance with the size of the internal volumes of cylinder bores 56 and 58.

In operation, vibrator 10 is reciprocated in the low frequency regions, e.g., from 0.5 Hz. through as high as 120 Hz., as dictated by control unit 18 in well-known manner. Hydraulic fluid from suply 26 via hydraulic supply lines 22 and 24 is reciprocally applied by means of servo valve 20 through ports 60 and 62 of manifold 28. Pressure application to one side of cylinder bores 56 and 58 will be applied via frame port 66, rod end port 70 and radial port 72 into the internal volumes 74 and 82 with communication therebetween through cross port 80. This pressure application drives the respective pistons 40 and 48 in expansion, i.e., downward as shown in FIG. 1. The opposite pressure application via frame port 64, rod end port 68 and radial port 76 then applies the reciprocal force to the other side of pistons 40 and 48, cylinder volumes 78 and 86 being in communication by means of cross port 84.

The opposed pressure applications to internal volumes 74 and 82, and 78 and 86, in reciprocation, then cause the reaction mass 30 to vibrate back and forth relative to frame 12, i.e., as secured by end frames 14 and 16, and the vibrational energy may then be coupled into the earth thereby to produce either compressional (P) waves or shear (S) waves, depending upon the particular frame base plate structure utilized. Thus, as mentioned previously, base plate structure secured to end frame 16 will allow coupling of the vibrational energy into the earth to produce compressional waves; and, base plate coupling that is equally compressive in vertical force to end plates 14 and 16 will generate shear wave energy.

The foregoing discloses a novel dual cylinder porting arrangement finding particular usage in vibrational seismic energy transducers. The cross porting scheme enables a reduction in metal removal from the piston rod ends, frame structure and manifold so that greater strength is achieved all around. Furthermore, the drilling of porting bores through the piston rod ends along the respective center axes also contributes to optimum structural rigidity of the shafts while allowing greater end surface for sealing and bolting functions. It should also be understood that multiples of greater than two piston assemblies may be utilized within a single reaction mass unit, and this is especially foreseen with respect to certain specific vibrational seismic transducer applications.

Changes may be made in the combination and arrangement of elements as heretofore set forth in the specifications and shown in the drawings; it being understood that changes may be made in the embodiments disclosed without departing from the spirit and scope of the invention as defined in the following claims.

What is claimed is:

1. A method of porting hydraulic fluid to a seismic vibrator of the type having a frame, reaction mass including plural internal cylinders, and plural respective double rod end pistons secured to said frame and disposed for controlled relative reciprocation within a respective internal cylinder, comprising:

communicating by cross-porting each of said internal cylinders on one side of said pistons;

communicating by cross-porting each of said internal cylinders on the opposite side of said pistons; and providing hydraulic fluid communication through a selected different piston rod end to each of the one and opposite sides of said internal cylinders to enable reciprocal drive of said reaction mass.

2. A method as set forth in claim 1 wherein two such internal cylinders and respective double rod end pistons are utilized.

3. A method set forth in claim 1 wherein hydraulic fluid communication to one cylinder side is through said frame and a first piston rod end, and fluid communication to the opposite cylinder side is through said frame and a second piston rod end.

4. A method as set forth in claim 3 wherein said internal cylinders are parallel.

5. In a hydraulic seismic energy transducer of the type having a frame, a reaction mass with plural internal cylinders, and plural respective double rod end pistons disposed for controlled relative reciprocation therein, the structure comprising:

first porting means providing hydraulic fluid communication through a selected first rod end to a respective cylinder on one side of the piston;

cross port means providing communication between all cylinders on said one side of the piston;

second porting means providing hydraulic fluid communication through a selected second rod end to a respective cylinder on the opposite side of the piston;

cross port means providing communication between all cylinders on said opposite side of the piston; and supply means providing hydraulic fluid reciprocally to said first and second porting means to drive said reaction mass relative to the frame.

6. The structure of claim 5 wherein there are two said plural internal cylinders disposed in parallel, having equal internal volumes, and said cross port means are formed therebetween at opposite ends of the cylinder volumes.

7. A seismic energy transducer of the hydraulic vibrator type having a frame and reaction mass as driven by reciprocal application of hydraulic pressure, comprising:

first and second piston bores formed in parallel through said reaction mass and defining therein first and second cylinders;

first and second piston means each disposed within said first and second cylinders and each extending opposing rod ends through said cylinder bores and outward of said reaction mass for rigid affixure to said frame;

first and second cross ports formed in the reaction mass and communicating between said first and second cylinders on opposite sides of said first and second piston means; and first and second ports disposed through common rod ends of said respective first and second piston means, said first port communicating with said first cylinders and first cross port, and said second port communicating with said second cylinder and second cross port.

* * * * *